United States Patent [19]

Frey et al.

[11] 4,150,631

[45] Apr. 24, 1979

[54] COAL FIRED FURANCE

[75] Inventors: Donald J. Frey, North Canton; Thomas B. Hamilton, Farmington, both of Conn.

[73] Assignee: Combustion Engineering, Inc., Windsor, Conn.

[21] Appl. No.: 864,181

[22] Filed: Dec. 27, 1977

[51] Int. Cl.[2] ..... F23K 1/00; F23D 1/00

[52] U.S. Cl. ..... 110/186; 110/265; 110/347

[58] Field of Search ..... 110/186, 188, 244, 263, 110/264, 265, 347

[56] References Cited

U.S. PATENT DOCUMENTS

| | | | |
|---|---|---|---|
| 2,243,909 | 6/1941 | Kruger | 110/347 |
| 3,180,289 | 4/1965 | Steinert | 110/265 |
| 3,203,463 | 8/1965 | Miller | 110/264 |
| 3,224,419 | 12/1965 | Lowenstein et al. | 110/264 |
| 3,934,522 | 1/1976 | Booker | 110/347 |

*Primary Examiner*—Kenneth W. Sprague
*Attorney, Agent, or Firm*—Edward L. Kochey, Jr.

[57] ABSTRACT

A tangentially fired pulverized coal furnace in which the means for introducing fuel and air from the corners operate as independent firing systems at low ratings and contribute to the fireball at higher ratings. The coal flow through a nozzle is deflected radially outwardly at low ratings and allowed to continue essentially straight at high ratings. A surrounding secondary air flow is concentrated at the coal stream and may be varied from a swirling action at low ratings to a parallel flow action at high ratings.

11 Claims, 4 Drawing Figures

COAL FIRED FURANCE

BACKGROUND OF THE INVENTION

This invention relates to tangentially fired pulverized coal furnaces and in particular to a fuel and air supply means therefore.

Tangentially coal fired furnaces include fuel nozzles which introduce a mixture of primary air and coal from the corners toward an imaginary circle in the center of the furnace. Secondary air is distributed around the introduced coal stream and in intermediate adjacent streams. The coal nozzle does not operate as an independent burner but rather introduces the coal to the swirling mass in the center of the furnace which is in fact the burner in this type furnace. Accordingly, precise control of air and coal to each of the nozzle locations is not required. Furthermore, the long turbulent flame provides time for cooling of the gases while combustion is still continuing thereby resulting in lower peak flame temperatures and a lower production of oxides of nitrogen as compared to alternative burning methods.

At high ratings, there exists a strong interchange of energy between flames eminating fom the various sources. It is this exchange that provides the energy for the volitization and subsequent ignition of incoming coal. As load is decreased this interchange of energy weakens, and at some point supplemental fuel injected in close proximity to the coal stream, must provide additional energy to augment the normal interchange.

At extremely low ratings there is a minimum furnace air requirement which demands substantial air flow beyond that required to burn the fuel. This results in a chilling effect on the combustion process, thereby aggravating the smoking tendency.

Once a parallel flow pattern leaving the nozzles is established, it is difficult to change this flow pattern with coal as compared to other fuels. The coal and transport or "primary" air itself have a larger weight mass with respect to the remainder or "secondary" air required to burn it as compared to oil or gas. The use of primary air at that location also decreases the amount of secondary air available to deflect the coal stream. Operations which are successful for manipulating an oil flame, therefore, will not necessarily be adequate when pulverized coal is the fuel.

SUMMARY OF THE INVENTION

It is an object of the invention to supplement tangential firing of coal with nozzles which will provide improved combustion and operate as independent firing systems at low ratings, but which will effectively contribute to the traditional tangential firing concept at high ratings.

The invention comprises a method and apparatus whereby coal and primary air are introduced through nozzles projecting tangent to an imaginary circle in the center of the furnace, while secondary air is supplied through a surrounding annulus. At low ratings, the coal mixture is deflected radially outwardly and simultaneously the secondary air is swirled and concentrated to intersect the deflecting coal stream. At high ratings, the deflection of the coal is minimized and the surrounding secondary air stream is changed to a parallel flow pattern.

The selective deflection of the coal stream is achieved by a conical deflector located adjacent the exit of the coal pipe which may be axially moved so as to vary the annular space available at the exit of the coal pipe. The secondary air flow is swirled by locating vanes in an annular space adjacent the exit of the duct and the parallel flow is accomplished by withdrawing the vanes to a location where the duct is not restricted. A restricting throat is located at the exit of the secondary air duct immediately adjacent the exit of the coal nozzle so that the secondary air stream is effectively concentrated at this location.

DESCRIPTION OF THE PREFERRED EMBODIMENT

Figure 1:
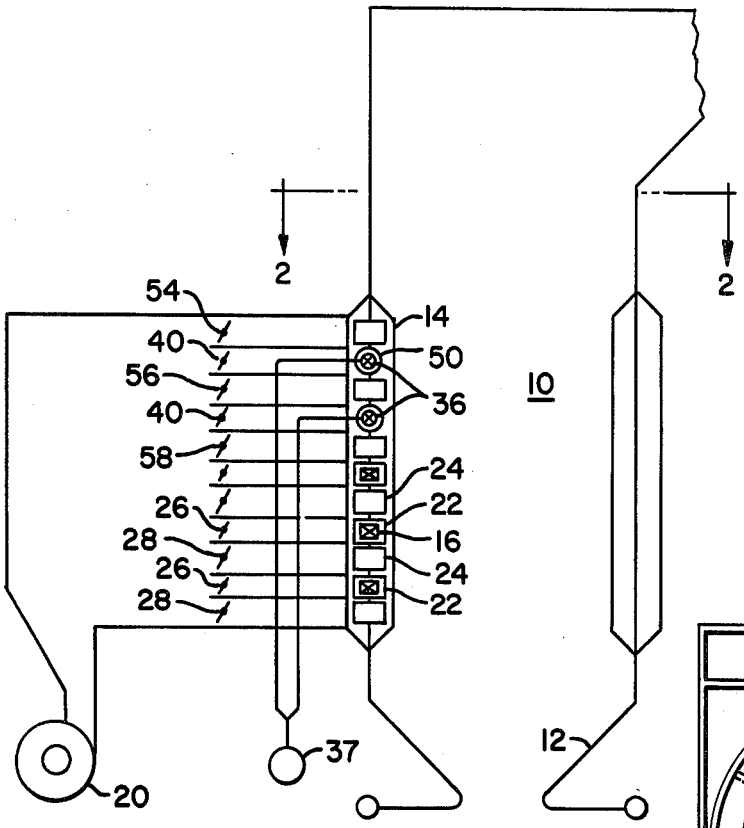
FIG. 1 is a schematic illustration of the furnace arrangement.
Figure 2:
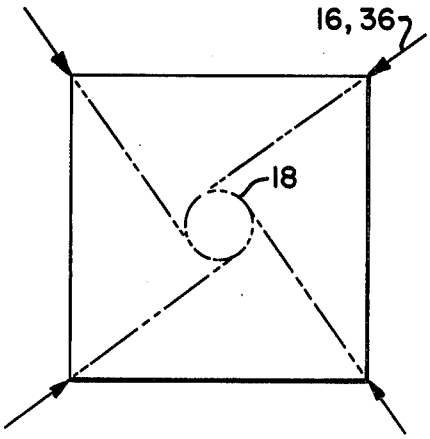
FIG. 2 is a schematic plan view showing the tangential direction of fuel introduction.
Figure 3:
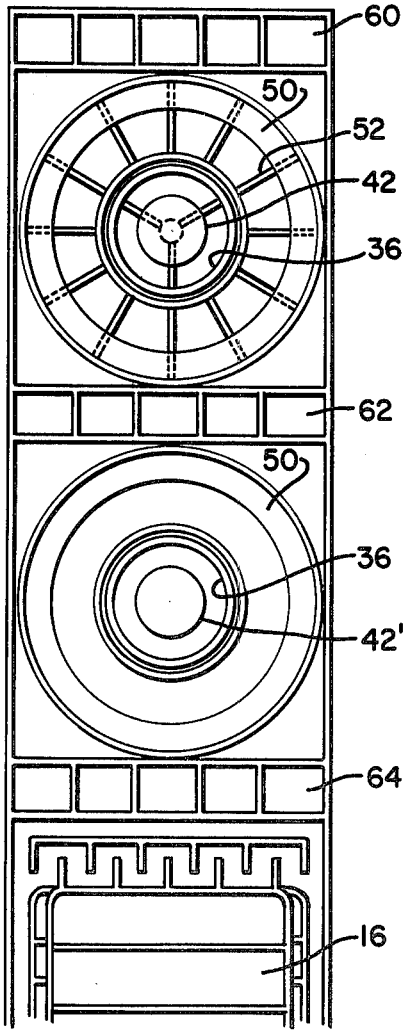
FIG. 3 is a front elevation of the air and coal nozzles in one corner of the furnace.

FIG. 1 illustrates a furnace 10 which is formed by a plurality of vertical tubes 12 lining the walls. These tubes are bent to form openings near the corners of the furnace into which the windbox arrangement 14 is installed. This windbox includes a plurality of main fuel nozzles 16 through which coal and primary air are introduced in a direction tangential to an imaginary circle 18 within the furnace. Secondary air is supplied by fan 20 and may be selectively directed through coal air nozzles 22 and auxiliary air nozzle 24. The relative proportion of air flow to each location is adjusted by regulation of dampers 26 and 28 respectively. While only one corner is illustrated, it is understood that corresponding arrangements exit in each of the corners of the furnace, and in some cases near the center of the front and rear walls of the furnace where two firing circles are located within a single furnace.

Ignitors may be included for initial ignition of the fuel and to stabilize ignition during periods of low load operation. Fuel and air thus introduced form a cyclonic action within the furnace and the furnace effectively operates as a single large burner. The scrubbing action due to this rotating motion thoroughly mixes the coal and the incoming air so that air need not be closely controlled to any particular corner. Cylindrical coal nozzles 36 are located in vertical alignment with the conventional fuel nozzles 16. A pulverizer/exhauster combination 37 operates to pass a flow of primary air conveying coal through the nozzle 36. A secondary air duct 38 surrounds each of the cylindrical coal nozzles. The quantity of air flowing through this duct is controlled by damper 40.

Figure 4:
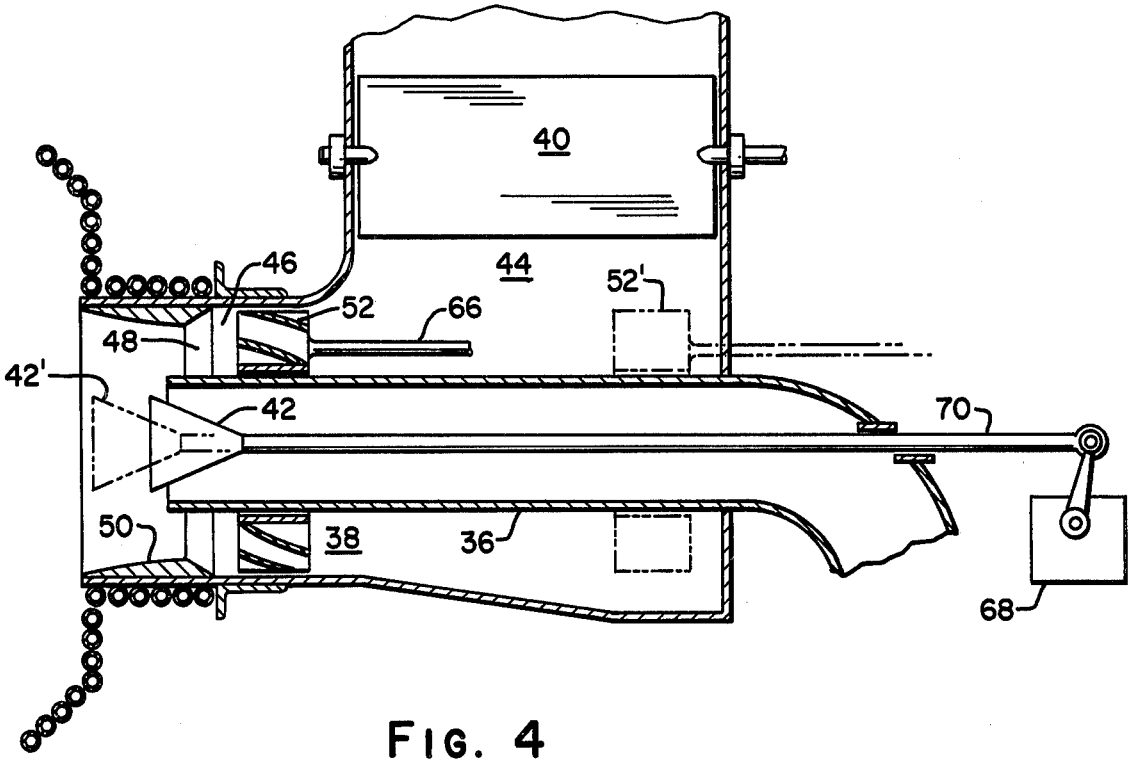
FIG. 4 is a plan view through one of the supplementary fuel nozzles.

A conical deflector 42 is axially located within the coal nozzle 36 immediately adjacent the exit of the coal nozzle into the furnace. In the location shown in solid lines in FIG. 4, the deflector operates to restrict the exit of the pipe in such a manner as to flare the coal stream leaving the nozzle. This operates to spread the flow of coal leaving the nozzle and to simultaneously produce a hollow cone of coal flow so that recirculation within this cone of heat from the furnace tends to maintain a stable flame. The secondary air flow passes through a large flow area section 44, an annular restricted area 46 and a further restricted area 48 which is formed by the throat 50. Helical vanes 52 within the annular space 46 impart a swirling motion to the secondary air. The throat 50 concentrates the secondary air flow and by restricting the air flow inwardly increases the swirling action. Thus a concentrated blast of secondary air is provided to intersect and swirl the spread coal stream eminating from coal nozzle 36. The discharge side of the throat is tapered outwardly to shape the flame. This method of operation and the apparatus as indicated in solid lines is used at low ratings and provides a stable burner suitation, whereby the cylindrical coal nozzles in each corner of the furnace may effectively operate independently of the fireball.

As rating is increased on the cylindrical coal nozzles, the amount of flare would normally increase, and particularly where the nozzles are located in the corners of the furnace the flame would then tend to sweep the walls and overheat tubes locally. Furthermore, the cylindrical coal nozzle would not appropriately operate as a fuel injection port to contribute to the fireball desired in a tangentially fired furnace.

As load on the nozzle 38 increases about 50 percent of its capacity, dampers 54, 56 and 58 (FIG. 1) are opened to permit introduction of some air through air nozzles 60, 62 and 64 located above, below and between the two fuel introduction locations. The swirling action caused by vanes 52 is still maintained with this additional air flow.

At approximately 70 percent of the coal nozzle capacity, the spinning action is no longer desired or required. At this point, vanes 52 are withdrawn by retracting rod 66 to place the vanes in the location indicated by 52'. By removing the vanes to this location the swirling action of the secondary air is stopped and the secondary air is introduced with the flow pattern parallel to the axis of the coal nozzle 36.

At the same time, actuator 68 operating through rod 70 moves the deflector 42 to the location indicated by 42' the annular space between the deflector cone and the coal nozzle is thereby substantially increases and the spreading action of the deflector is substantially decreases. It would be desirable to completely eliminate the deflection if this could be accomplished in a mechanically simple and reliable manner. Under this condition of operating at high ratings, all of the flow is essentially parallel to the axis of the nozzle and is thereby effectively directed to the fireball in the center of the furnace to accomplish the tangential firing furnace conditions.

As load is increased on the unit, additional coal is introduced through the conventional fuel nozzles 16. These nozzles may be of the tilting type while coal nozzles 36 remain a fixed nozzle for the purpose of simplifying the construction. The method of operation and construction of the invention produces a spinning spreading flame which will operate in a stable manner at low ratings and yet retains the classical advantages of tangential firing at high ratings with the nozzle 36 still contributing to the fuel burning capacity of the unit.

It will be understood that the embodiment shown and described herein is merely illustrative and that changes may be made without departing from the scope of the invention as claimed.

What is claimed is:

1. A tangentially fired pulverized coal furnace having walls, and a plurality of fuel and air introducing means located in the walls, each comprising: a cylindrical coal nozzle with its axis directed toward an imaginary circle in said furnace; means for passing a flow of primary air and coal through said coal nozzle; means for selectively spreading the flow of coal leaving said nozzle; a secondary air duct surrounding said coal nozzle; means for passing flow of secondary air through said secondary air duct, whereby the secondary air intersects the spread flow of coal; and means for selectively varying the air flowing through said secondary air duct between a swirling flow pattern and a parallel flow pattern.

2. An apparatus as in claim 1 wherein said means for selectively spreading the flow of coal comprises: a generally conical deflector located within said coal nozzle adjacent the exit thereof, and means for axially moving said deflector to decrease the amount of spread of the flow of coal.

3. An apparatus as in claim 2 wherein said secondary air duct includes a throat which restricts the secondary air flow at an area adjacent the exit of said coal nozzle.

4. An apparatus as in claim 1 wherein said secondary air duct includes a throat which restricts the secondary air flow in an area adjacent the exit of said coal nozzle.

5. An apparatus as in claim 4 wherein said secondary air duct has an annular flow area immediately upstream of said throat; and said means for selectively varying the air flowing through said secondary air duct comprises; helical vanes selectively positionable at said annular area or at a location remote from said annular area whereby a swirling flow is established when the vanes are in the annular area and a parallel flow is established when the vanes are remote therefrom.

6. An apparatus as in claim 3 wherein said furnace has a rectangular plan area and said fuel and air introducing means are located in the corners of said furnace.

7. An apparatus as in claim 6 having also nozzles for introducing additional secondary air above and below the exit of said secondary air duct, and means for regulating introducing additional secondary air through said nozzles.

8. An apparatus as in claim 7 having also main fuel nozzles located in each corner of the furnace in vertical alignment with said cylindrical coal nozzles.

9. A method of operating a pulverized coal burning furnace comprising: at a low rating introducing coal and primary air through nozzles projecting tangent to an imaginary circle in the furnace, and deflecting the coal outwardly from the axis of the nozzles, introducing a swirling flow of secondary air surrounding said nozzles and intersecting the deflected coal stream; at a higher rating introducing coal and primary air through said nozzles with minimal deflection of coal from a line of flow parallel to the axis of said nozzles, and introducing as a parallel flow stream the secondary air which was swirling at low rating.

10. An apparatus as in claim 4 wherein said throat annularly surrounds said secondary air duct and restricts the secondary air flow inwardly.

11. An apparatus as in claim 10 wherein said throat has a gradually diverging downstream portion.

* * * * *

UNITED STATES PATENT OFFICE

CERTIFICATE OF CORRECTION

Patent No. 4,150,631 Dated April 24, 1979

Inventor(s) Donald J. Frey and Thomas B. Hamilton

It is certified that error appears in the above-identified patent and that said Letters Patent are hereby corrected as shown below:

Column 1, line 25, change "fom" to --from--.

Column 2, line 37, change "exit" to --exist--.

Column 3, line 10, change "suitation" to --situation--.

Column 3, line 21, after "increases" insert --to--.

Signed and Sealed this

*Eleventh* Day of *September 1979*

[SEAL]

*Attest:*

*Attesting Officer*

LUTRELLE F. PARKER

*Acting Commissioner of Patents and Trademarks*